US008950637B2

(12) United States Patent
Wilkins

(10) Patent No.: US 8,950,637 B2
(45) Date of Patent: Feb. 10, 2015

(54) VALVED FLUID TRANSPORT CONTAINER

(76) Inventor: Conrad H. Wilkins, Sorrento (CA)

( * ) Notice: Subject to any disclaimer, the term of this patent is extended or adjusted under 35 U.S.C. 154(b) by 149 days.

(21) Appl. No.: 13/597,087

(22) Filed: Aug. 28, 2012

(65) Prior Publication Data

US 2014/0061254 A1 Mar. 6, 2014

(51) Int. Cl.
*B65D 83/00* (2006.01)
*B67D 3/00* (2006.01)

(52) U.S. Cl.
USPC ..... 222/466; 222/470; 222/481; 222/529; 222/530; 222/538; 222/562; 222/543; 222/523

(58) Field of Classification Search
CPC ..... B65D 1/14; B65D 1/18; B65D 1/20; B65D 23/10; B65D 25/28; B65D 25/2811; B65D 25/2826; B65D 25/2882; B65D 25/2885; B65D 25/2894; B65D 25/30; B65D 25/44; B65D 47/061; B65D 47/205; B65D 47/2093; B65D 47/263; B65D 47/283; B65D 47/32; B65D 7/005; B65D 3/0051; B65D 3/0061; B65D 83/00
USPC ..... 222/189.9, 466, 470, 478, 481, 481.5, 222/482, 488, 566, 527, 528, 529, 530, 538, 222/539, 562, 543, 523, 524; 141/353
See application file for complete search history.

(56) References Cited

U.S. PATENT DOCUMENTS 479,217 A * 7/1892 Kaplan ..... 141/308
579,627 A * 3/1897 Wilson ..... 222/109
657,636 A * 9/1900 Bingham ..... 222/487
701,316 A * 6/1902 Edwards ..... 222/470
756,373 A * 4/1904 Joyce ..... 222/470
873,941 A * 12/1907 Irving ..... 222/471
1,006,078 A * 10/1911 Fulford ..... 222/523
1,034,897 A * 8/1912 Fusner ..... 222/509
1,140,034 A * 5/1915 Hansen ..... 222/189.01
1,393,331 A * 10/1921 Wilson ..... 222/525
1,595,231 A * 8/1926 Dryer ..... 222/523
1,957,735 A * 5/1934 Straub ..... 222/401
2,049,900 A * 8/1936 Evans et al. ..... 222/488
2,220,466 A * 11/1940 Tamminga ..... 222/246
2,328,020 A * 8/1943 Johnson ..... 222/520
2,898,014 A * 8/1959 Borah ..... 222/481.5
3,006,506 A * 10/1961 Germano ..... 222/49
3,717,289 A 2/1973 Laurizio
3,794,235 A 2/1974 Flider
3,856,188 A * 12/1974 Newby ..... 222/535
4,063,667 A 12/1977 Flider
4,069,946 A 1/1978 Flider
4,351,455 A 9/1982 Bond
4,478,242 A 10/1984 Bond
4,667,710 A 5/1987 Wu
4,726,491 A * 2/1988 Moon ..... 222/1
4,834,151 A 5/1989 Law (Continued)

*Primary Examiner* — Patrick M Buechner
(74) *Attorney, Agent, or Firm* — Antony C. Edwards

(57) ABSTRACT

A fluid flow-control valve is housed within a fluid transport container or vessel. The valve is operated by a trigger actuating a plunger or shaft. The trigger is located in the handgrip space of a pouring handle so as to resiliently provide one-handed control of fluid flow from the vessel. The valve is resiliently biased to a closed state. A telescopically extendable spout is attached to and housed within the main body of the valve and may include an integral breather passageway. When the spout is retracted it locks out the operation of the trigger.

23 Claims, 8 Drawing Sheets

(56) References Cited

U.S. PATENT DOCUMENTS

| | | | | | |
|---|---|---|---|---|---|
| 5,056,691 | A | * | 10/1991 | Tolbert | 222/466 |
| 5,076,333 | A | | 12/1991 | Law | |
| 5,249,611 | A | | 10/1993 | Law | |
| 5,419,378 | A | | 5/1995 | Law | |
| 5,671,868 | A | | 9/1997 | Herr | |
| 5,704,408 | A | | 1/1998 | Law | |
| 5,762,117 | A | | 6/1998 | Law | |
| 5,871,127 | A | | 2/1999 | Overtaker et al. | |
| 5,944,224 | A | * | 8/1999 | Hodge et al. | 222/131 |
| 5,988,458 | A | * | 11/1999 | Messner | 222/478 |
| 6,003,735 | A | | 12/1999 | Strecker | |
| 6,045,013 | A | * | 4/2000 | Yang | 222/510 |
| 6,155,464 | A | * | 12/2000 | Vachon | 222/484 |
| 6,227,419 | B1 | | 5/2001 | Raboin | |
| 6,318,604 | B1 | * | 11/2001 | Messner | 222/478 |
| 6,364,176 | B1 | | 4/2002 | Kilian | |
| 6,435,380 | B1 | | 8/2002 | Raboin | |
| 6,478,058 | B1 | | 11/2002 | Pears | |
| 6,772,918 | B2 | | 8/2004 | Mack, Jr. | |
| 6,863,098 | B2 | | 3/2005 | Chrisco et al. | |
| 7,077,294 | B2 | * | 7/2006 | Nusbaum et al. | 222/153.06 |
| 7,854,357 | B2 | * | 12/2010 | Hill | 222/475 |
| 8,403,185 | B2 | * | 3/2013 | Vachon | 222/484 |
| 8,561,858 | B2 | * | 10/2013 | Vachon | 222/484 |
| 8,567,646 | B1 | * | 10/2013 | Cray | 222/482 |
| 2007/0114245 | A1 | * | 5/2007 | Trent, Jr. | 222/158 |
| 2007/0246488 | A1 | * | 10/2007 | Cash et al. | 222/466 |
| 2014/0061254 | A1 | * | 3/2014 | Wilkins | 222/466 |

* cited by examiner

VALVED FLUID TRANSPORT CONTAINER

FIELD OF THE INVENTION

The invention relates to portable vessels for liquids and in particular vessels incorporating manually operable trigger-actuated flow control valves to control fluid flowing from the vessel during dispensing of liquids from the vessel spout.

BACKGROUND OF THE INVENTION

It is known, when using a fluid containment vessel for applications such as storing and transporting gasoline, that pouring the contents from the vessel may result in spillage due to lack of, or inadequate, flow control of the fluid leaving the vessel. A solution to this problem is to incorporate a manually operable flow control valve to enable the user or operator to control the flow of fluid being poured from the vessel. Parts of many common devices are frequently stored within the vessel, submerged in the fluid in the vessel and require removal by hand so as to be attached externally to the vessel for use in pouring. Consequently, fluid from the vessel may be spilled during this process, contaminating the hands of the operator and the surrounding environment.

In the prior art, as described below by way of example, devices to meter the flow of fluid from a vessel have a significant part of their valve or spout external to the vessel. Such designs may expose the metering valve or spout to damage if the vessel is dropped or struck accidentally.

Ergonomic design is related to the ease of use and the comfort of the operator when using a fluid container. Products in this field frequently do not take into account such ergonomics. A device that is awkward to use may cause an operator to try and find a way to use it comfortably. This may entail using the device differently from how the device was intended and designed to be used. This may lead to dangerous situations if, for example, the vessel contains flammable or corrosive liquids. Hence poor ergonomic design may compromise the operator's safety. The present invention seeks to provide improved safety for the operator.

In the prior art applicant is aware of U.S. Pat. No. 1,393,331 which issued Oct. 11, 1921 to Wilson for a Combined Spout and Valve for Liquid Container in which is described a valved spout which may be opened or closed by a rotary or a vertical movement and the flow of the liquid therethrough regulated by either of these movements or by a combination of the movements whereby the flow is regulated to the desired extent. The valved spout is mounted within the casing of a liquid receptacle. The valved spout fits snugly within the casing so as to permit both rotary and vertical movement therein and, when closed, lies substantially flush with the top of the container.

U.S. Pat. No. 3,794,235 which issued to Flider on Feb. 26, 1974, for a Plastic Safety Container for inflammables, describes a safety container having a pair of openings, one for venting and filling, and one for pouring. An integral upstanding thickened fin and handle combination is formed on the outside surface of the container which facilitates the attachment of a trigger controlled safety cap linkage. A safety cap is positioned over the filling and pouring neck. The safety cap is controlled by the trigger and its associated linkage mounted on the fin. The trigger is squeeze actuated to impart a sliding motion which in turn opens the cap against the return bias of a spring.

U.S. Pat. No. 4,063,667 which issued to Flider on Dec. 20, 1977 for a Non-Metallic Safety Filling Container discloses a container having openings for venting, pouring and filling, wherein a trigger mechanism is mounted to the container which simultaneously vents the container and slides a ported cylinder into position to complete a pouring path from the interior of the container through the pour spout.

U.S. Pat. No. 4,069,946 which issued Jan. 24, 1978 to Flider for a Consumer Safety Container for Inflammables, describes a container formed as a hollow chamber having formed therein a number of tubular extensions with openings for filling, pouring and venting the container. A spring-loaded compression closure device is mounted in these openings to seal the container. Flammable liquid may filled into or dispensed from the container by release insertion means which disengage the compression closure device.

U.S. Pat. No. 4,667,710 which issued May 26, 1987 to Wu for a Liquid Pouring Device, describes a liquid pouring device having a conduit, a screwed cap, a partition plate, a tension spring, a valve collar and a funnel. The partition plate divides the conduit for the flow of liquid and air. A tension spring is fitted over the conduit between a valve collar and flange of the conduit. The funnel is connected with the valve collar. The funnel consisting of a tapering tube is provided on the valve collar for pouring liquids into containers that have openings of different calibers. The valve collar is biased by the spring to stop the flow of liquid from the conduit. When the funnel is inserted into the opening of the empty container into which liquid is to be poured, the weight of the liquid container and a force applied on the container causes the conduit, partition plate and stopper as a whole to slide down the valve collar which is placed in the opening of the container and kept from moving downward thereby. The stopper moves away from the valve collar forming an opening from which the liquid in the container flows into the empty container. The spring returns the conduit, partition plate and stopper as a whole upwardly once the force applied on the container is removed, thereby stopping the flow of liquid.

Applicant is also aware of United States patents issued to Law, which may be exemplified by U.S. Pat. No. 5,704,408 which issued Jan. 6, 1998 for a Pour Spout wherein Law describes a hollow tube attachable at one end to a container of fluid and having at the other end a fluid conduit termination disc separated from the end of the hollow tube by a space defining a fluid discharge opening. A slide valve on the exterior of the tube is biased to a closed position engaging a fluid conduit termination disc and precluding fluid transfer until the discharge opening is inside a receiving vessel. A barricade is disposed across the interior of the tube at an inclination relative to the longitudinal axis thereof. Formed through the barricade is at least one elongated aperture extending continuously in the tube. When the slide valve is opened fluid passes through the barrier while air is simultaneously exchanged there through venting the container.

Applicant is also aware of U.S. Pat. No. 6,435,380 which issued Aug. 20, 2002 to Rabowin for a Self-Sealed Spout. Rabowin discloses a spout for a container having a conduit which connects at one end to the container and wherein the other end is configured to be inserted into an opening. A closure plate extends across the diameter of the conduit to prevent flow through the conduit. A sleeve is moveably responsive to inserting the conduit into the opening so as to move the closure plate from a closed position into an open position. The sleeve is spring loaded to hold the closure plate normally closed. A vent tube is coupled to and supports the closure plate centrally disposed in the conduit. The vent tube permits a flow of air from the inlet into a vent passage during a flow of fluid from the container into the opening. An end cap is coupled to the vent tube at the inlet and configured to fluidly seal the conduit in conjunction with the closed position of the closure plate.

U.S. Pat. No. 6,478,058 which issued. Nov. 12, 2002, to Pears for a Spout with Cut-Away openings, describes a pouring spout that has a inner sleeve that is pushed past an outer sleeve of the spout for pouring liquids through an intake end of the sleeve to a pouring end of the sleeve so as to pour the liquid from the inner sleeve. The outer sleeve is biased towards an end cap to form a slide valve. A stop mechanism prevents movement of the inner sleeve in the direction of the pouring end relative to the outer sleeve.

SUMMARY OF THE INVENTION

In summary, the valved fluid transport container according to the present invention may be characterized in one aspect as including a hollow vessel having a spout aperture and a first handle oppositely disposed on the vessel to the spout aperture. The first handle has a corresponding handle cavity. The handle cavity has a side wall common with the vessel. The side wall has a shaft aperture therein.

Nested first, second and third tubes are mounted in the spout aperture. Each of the first, second and third tubes have opposite downstream and upstream ends. The downstream and upstream ends have openings therein. The first tube is telescopically nested for first telescopic motion relative to and within the second tube. The third tube is telescopically mounted on, for second telescopic motion relative to the second tube. The second tube is rigidly mounted into the spout aperture so as to be contained within the vessel.

The first and second telescopic motions are along a common centroidal longitudinal axis of the tubes. The longitudinal axis intersects the first handle cavity. A valve shaft is mounted along the longitudinal axis and journalled through the shaft aperture so as to dispose a handle end of the valve shaft in the first handle cavity of the first handle. An opposite hollow end of the valve shaft, opposite to the handle end, is mounted to the third tube whereby translation of the valve shaft along the longitudinal axis translates the third tube between its seal open and seal closed positions. In the seal closed position the third tube is in a lockable position when the first tube is in a corresponding storage position nested in the second tube.

A selectively releasable lock is mounted to, for selectively releasable locking cooperation between the second tube and the third tube when the third tube is in the lockable position. The lock is locked by the telescopic motion of the first tube into the storage position in the second tube so as to engage the lock and whereby the third tube is immobilized relative to the second tube.

A sidewall of the second tube has a fluid-flow aperture formed therein. The second tube also has a first airflow aperture formed therein, upstream of the fluid-flow aperture relative to a direction of fluid flow from the vessel through the first and second tubes when decanting a fluid from the vessel. Downstream and upstream seals are provided on respectively the downstream and upstream ends of the second and third tubes. The seals seal so as to prevent, when the third tube is in the seal closed position, the fluid flow through the fluid-flow aperture, and the first airflow through the airflow aperture respectively.

As the first tube is telescopically extended from the second tube, the downstream end of the first tube extends from the vessel and the upstream end of the first tube disengages so as to unlock the lock. Thereafter translation of the valve shaft into the first handle cavity retracts the third tube from the seal closed position into the seal open position. This unseals the upstream and downstream seals so as to open a fluid path for the fluid flow, whereby the fluid in the vessel flows through both the fluid-flow aperture and the extended first tube to exit from the first tube, and so as to open an airflow path for the airflow through the first and second tubes, through the first airflow aperture, and into the vessel.

Preferably, the first tube includes an air channel to separate the air flow from the fluid flow and so as to define an airflow path which is separated from the fluid flow path in the first tube.

For sake of providing a frame of reference, the vessel has an upper end and an opposite lower end, and a front end and an opposite back end. Preferably the spout aperture is in the front end and the first handle is on the back end. The tubes have upper sides and opposite lower sides. The air channel may be formed along the upper side of the first tube. For example, the channel may be formed within the first tube.

In one embodiment, the lock includes at least one dog positioned in the second tube so as to be engaged by the first tube when in the storage position. The engagement of the first tube with the at least one dog biases an end of the at least one dog into locking engagement into a female depression such as a slot or groove in the third tube, when in the seal closed position. Each dog may include at least one flexible member, for example a spring arm or the end of a spring.

In a preferred embodiment, a first spring is mounted in the second tube so as to resiliently compress and expand between an upstream end wall of the upstream end of the second tube and the upstream end of the first tube to thereby resiliently bias the first tube to telescopically extend outwardly of the second tube from the storage position. A second spring may be provided which cooperates with the valve shaft to resiliently urge the third tube into the seal closed position. In one embodiment, the second spring cooperates between the valve shaft and the handle side wall.

A spout retainer may be provided for selectively retaining the first tube in the storage position. The spout retainer may include a retainer cap releasably mountable onto, so as to cover, the spout aperture when the first tube is in the storage position.

In a preferred embodiment the valve shaft has a hollow end opposite the handle end. The hollow end is in airflow communication with the third tube. A second airflow aperture is formed in the hollow end of the valve shaft so that the airflow path flows serially through the channel, the second tube, and the hollow end of the valve shaft. Preferably the second airflow aperture is in an upper side of the hollow end.

Preferably the tubes are substantially cylindrical, the hollow end is substantially cylindrical, the fluid-flow apertures are formed respectively in a lower side of the downstream end of the second tube and in a lower side of the upstream end of the first tube. Advantageously, a flashback screen is mounted in the airflow path between the first and second airflow apertures.

In the preferred embodiment the tubes, the valve shaft, the spout aperture, the first handle and the first handle cavity all lie substantially in a common plane, wherein the common plane may substantially bisect the vessel, in which case the vessel may be substantially a mirror image on either side of the common plane.

Further advantageously the downstream end of the first tube is substantially flush with the spout aperture when in the storage position and wherein the handle end is substantially fully contained within the first handle cavity. In the preferred embodiment a second handle is provided lying substantially in the common plane on the upper end of the vessel. The second handle is for lifting and carrying the vessel and for assisting in pouring fluid from the vessel.

In a typical embodiment, a filling aperture is formed in the upper end of the vessel. The second handle may have a corresponding second handle cavity, so that the first handle cavity and the second handle cavity define a passageway therebetween within the vessel. Advantageously the filling aperture is substantially aligned with the passageway so that fluid poured into the vessel may pass between the two handle cavities without obstruction and so that the airflow escaping from the second airflow aperture into the vessel rises through the passageway towards the filling aperture when the vessel is inclined forwardly to thereby tilt the longitudinal axis and the tubes for decanting of the fluid flow. A cap is provided which is releasably mountable onto the filling aperture so as to releasably seal the filling aperture.

The first tube may be a spout. The second tube may be a main valve body. The third tube may be a valve outer sleeve.

Characterized in other words, the valved fluid transport container may be described as including a hollow container having a continuous interior wall. At least one, and preferably two handles are formed on the body of the vessel, which may be manufactured by blow moulding using a high density plastic material suitable for the containment of potentially volatile or corrosive fluids to conform to corresponding required safety standards. A valve is operable between an open position and a sealed position upon activation of a trigger device coupled to the valve. A telescoping fluid delivery spout is normally housed in a storage position within a bore of the valve body. The spout and valve assembly may also include a compression spring for the resilient partial ejection of said spout from within the valve body. The valve may further include a means to bias the valve, such as a further spring, to the sealed position. The spout and valve assembly may further include a lock to releasably lock the valve in a closed and sealed state when the telescoping spout is in its storage position within the bore of the valve.

In a further aspect, the invention may comprise a valve including a main valve body having primary and secondary apertures. An outer valve body such as a sleeve forms seals between, respectively, the primary and secondary apertures of the main valve body and an air passageway in the outer valve body and the fluid in the vessel. A primary seal may be located beside the primary aperture or apertures of the main valve body. The primary seal is engaged by the outer sleeve so as to separate the inner volume of the vessel from the primary apertures in the main valve body. The secondary apertures in the main valve body allow the flow of air into the vessel from the spout and the inner volume of the main valve body. The air flows through the second seal, when opened, which may be located between the outer sleeve and the main valve body, distal to the pouring spout. The air passage may continue into a hollow trigger shaft. The air passage in the hollow trigger shaft continues along the shaft to a vent aperture or port from which the air vents into the vessel. The aperture is at a distance from the valve. Preferably the vent aperture is on the upper side of the shaft. When the vessel is tipped or inclined and when the operator opens the valve in order to pour the fluid from the vessel, the vent aperture in the trigger shaft is positioned close to or adjacent the surface of the fluid being poured inside the vessel. This places incoming air behind the bulk of the outgoing fluid and assists in overcoming the tendency for fluid to exit via the air tube. This incoming air replaces the fluid leaving the vessel and assists by improving the fluid flow rate, overcoming the tendency for a vacuum to form.

The valve is activated via the valve trigger handle. The valve trigger handle is located in the vicinity of the vessel's pouring handle. The trigger handle is attached to the trigger shaft. The design of the trigger handle permits it to be pulled by one or more fingers of the operator's hand holding the pouring handle. The trigger handle maybe activated with the use of the left or right hand. The shaft also incorporates guide slots to prevent the rotation of the trigger shaft, keeping the trigger handle in a preferred orientation protected within the pouring handle cavity. The guide slots are engaged by the shaft support boss, to guide the shaft and keep it in the correct orientation. The other end of the trigger shaft is attached to the valve outer sleeve. The trigger activation shaft penetrates the outer wall of the vessel through a sealing device attached to the vessel body in the pouring handle cavity. The sealing device may include a supporting guide boss for the shaft, a compression spring and a resilient sealing boot. The sealing device may be secured to the body of the vessel with a lock washer and nut on the outside of the vessel engaging a post on the boss where the trigger attaches to the shaft.

The resilient boot may be corrugated or accordioned. A small diameter aperture at one end seals around the shaft. The opposite, larger end of the boot mounts to the bushing in the vessel wall. A compression spring is mounted within the boot and around the trigger shaft, butting up against a shoulder on the shaft inside the boot. The other end of the spring presses against the bushing support guide boss. The spring biases the valve to the closed position when the trigger is not activated.

The telescoping pouring spout of the valve system is retained and housed within the bore of the valve main body when not in use. This prevents damage to the spout and limits the chance of foreign contaminates entering the spout's exposed end. When not in use, the spout is normally stored within the valve body, held in place by a spout keeper or retainer that covers its exposed end that may protrude slightly from the outside of the valve cap. The spout keeper is attached to the vessel via a simple tether. The force of the spout ejection spring assists in keeping the spout retainer cap in place.

A boss formation on the vessel body below the valve mounting orifice is used as a locking tab for securing the valve cap. Teeth on the valve cap engage with, as they pass across the formation on the boss, their ratcheting shape only allowing them to move one way past the boss. The teeth are biased in a direction to allow tightening of the cap but not removal.

The telescoping spout is housed within the main valve body axially to it. Between the bottom of the spout and the bottom of the main valve body a compression spring formation is normally in compressed state when the spout is within the valve main body. The spring is activated when the spout keeper, that holds the spout within the valve, is released. The released compression spring pushes on the spout to telescope it substantially out of the valve main body so that the spout can be used for dispensing of the fluid from within said vessel. Full ejection of the spout is prevented by the use of a stop such as a spout keeper bushing. The spout keeper bushing is formed with flat faces in its bore that follow similar faces on the spout outer walls. The outer wall of the spout may have a number of such grooves or indented channels running down the outside from the exposed pouring end toward the end retained within the valve. The spout keeper bushing has a tapered upstream bore that engages with the upstream end of the spout which is also tapered preventing the full ejection of the spout. The spout keeper bushing is held in place with the valve retaining cap. When the spout is in the fully extended position, apertures in the sidewall of the spout align with the primary apertures of the valve main body through similar apertures in the spout keeper bushing. When the valve is biased to the open position fluid can flow freely through the aligned apertures, through the bore of the spout and out of the vessel. The air vent passage opens and closes simultaneously with the fluid passage. There is a separate passage formed within the spout to channel air to the back of the spout and into the inner volume of the valve main body, bypassing the fluid apertures. There is a spout spring plug in the upstream end of the spout preventing fluid flowing down the air passage next to the fluid passage. When the trigger activation shaft is pulled the air passage is completed.

A lock locks the valve in a closed position when the telescoping spout is in its stored position within the valve body. The lock may be a simple formation on the bottom of the spout ejection spring. The formation is deflected and displaced by the spout when the spout is pushed fully within the valve body. The formation when displaced is designed to come into contact with the outer valve sleeve and engage in a depression in the inside wall of the outer sleeve. Engaging the formation of the spring with the outer sleeve causes them to lock together and prevent the accidental sliding movement of the outer sleeve if the trigger mechanism is activated.

Alternatively the locking device may be formed by locking dogs formed in the side walls of the second tube, ie., valve main body that are displaced outwardly into a corresponding cavity formed to receive them in locking engagement therein in the third tube, ie, the outer sleeve, when the first tube, ie, the spout is in the stored position.

BRIEF DESCRIPTION OF THE DRAWINGS

FIG. 4*a* showing the spout keeper removed and FIG. 4*b* showing the spout keeper in place, and illustrating the ratcheted safety lock for the valve cap.

DETAILED DESCRIPTION OF EMBODIMENTS OF THE INVENTION

Figure 1:
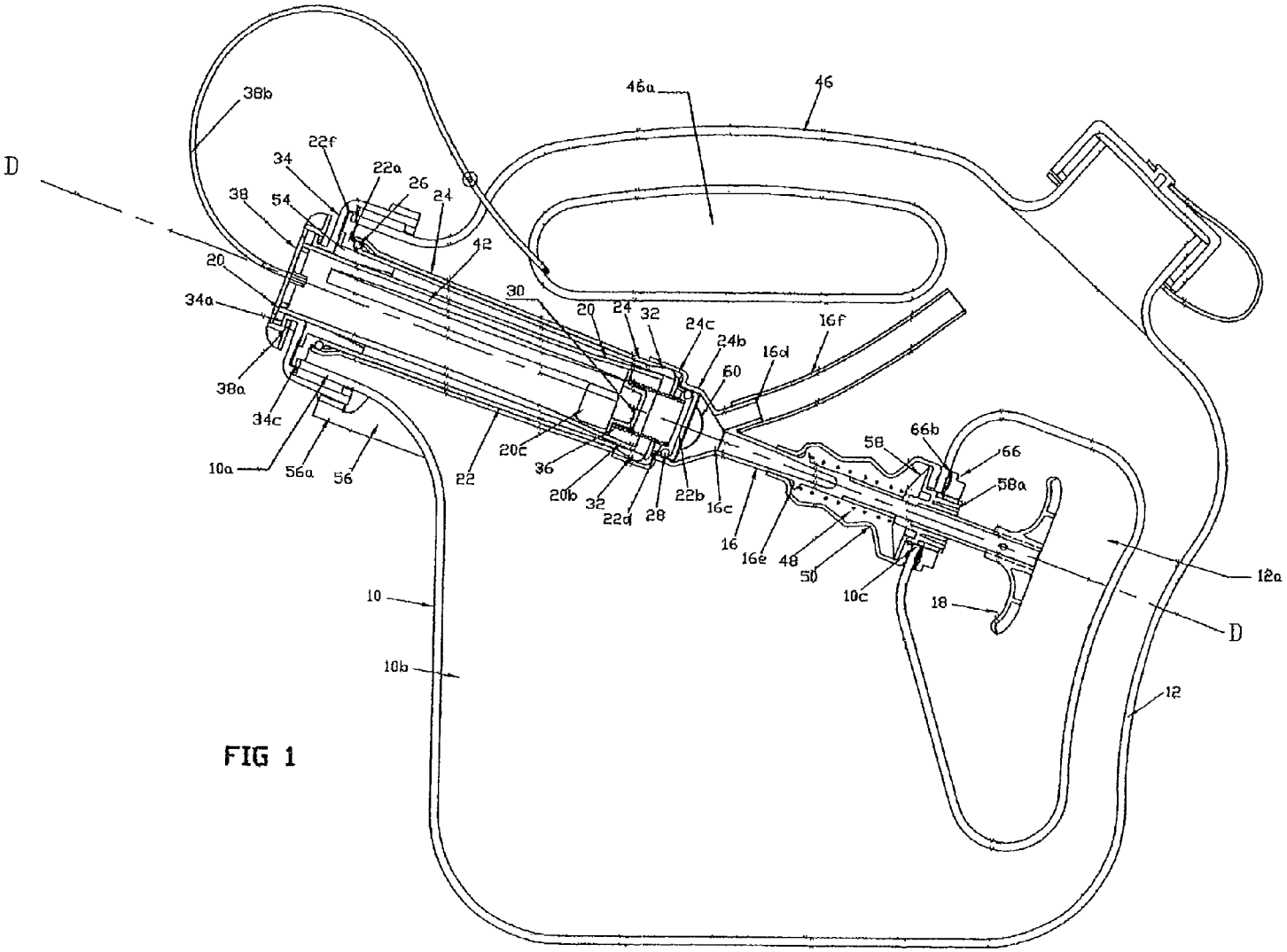
FIG. 1 illustrates a side, longitudinal sectional view of a preferred embodiment of the valved fluid transport vessel of the present invention in its capped and valve-closed and sealed state.
Figure 1A:
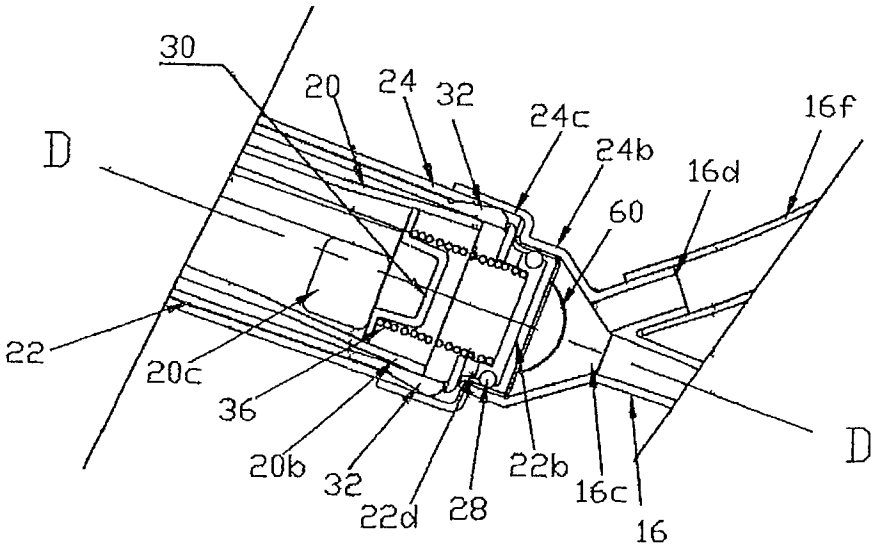
FIG. 1*a* is and enlarged view of a portion of FIG. 1 showing the valve lock.

In the illustrated embodiments which are not intended to be limiting, the valved fluid transport container includes a hollow vessel 10 having a spout aperture 10*a* formed in the front thereof and a first or pouring handle 12 oppositely disposed on the back of vessel 10. Pouring handle 12 has a corresponding first handle cavity 12*a* sized to accept the fingers 8 of the operator's hand when grasping pouring handle 12. Handle cavity 12*a* is defined in part by handle 12 and by oppositely disposed handle side wall 10*b*. Handle side wall 10*b* also forms a side wall of vessel 10. A shaft aperture 100 is formed in handle side wall 10*b*. Spout aperture 10*a*, shaft aperture 10*c*, and handle 12 all lie substantially in a common plane A which bisects vessel 10 into mirror image halves.

Valve 14 is rigidly mounted in spout aperture 10*a* so as to also lie substantially in plane A. Valve 14 is actuated by valve shaft 16 which is journalled through shaft aperture 10*c* and mounted at its hollow end 16*a* to valve outer sleeve 24 of valve 14, and at its opposite trigger handle end 16*b* to trigger handle 18.

Valve 14 includes three nested hollow tubes wherein the innermost or first tube is spout 20, the main or second tube is valve main body 22, and the third or outer tube is valve outer sleeve 24. Each of the three tubes; namely, spout 20, valve main body 22, and valve outer sleeve 24, each have opposite downstream and upstream ends, 20*a*, 20*b*, and 22*a*, 22*b*, and 24*a*, 24*b* respectively.

Spout 20 is telescopically nested within valve main body 22 for telescopic motion in direction B relative thereto. Valve outer sleeve 24 is telescopically mounted on valve main body 22 so as to provide a second telescopic motion in direction C of valve outer sleeve 24 relative to valve main body 22. Valve main body 22 is rigidly mounted into spout aperture 10*a* of vessel 10. The telescopic motions of spout 20 and valve outer sleeve 24 in directions B and C respectively are along valve longitudinal axis D which extends centroidally through valve 14 and valve shaft 16, and wherein axis D intersects handle 12 and corresponding handle cavity 12*a*.

Figure 2:
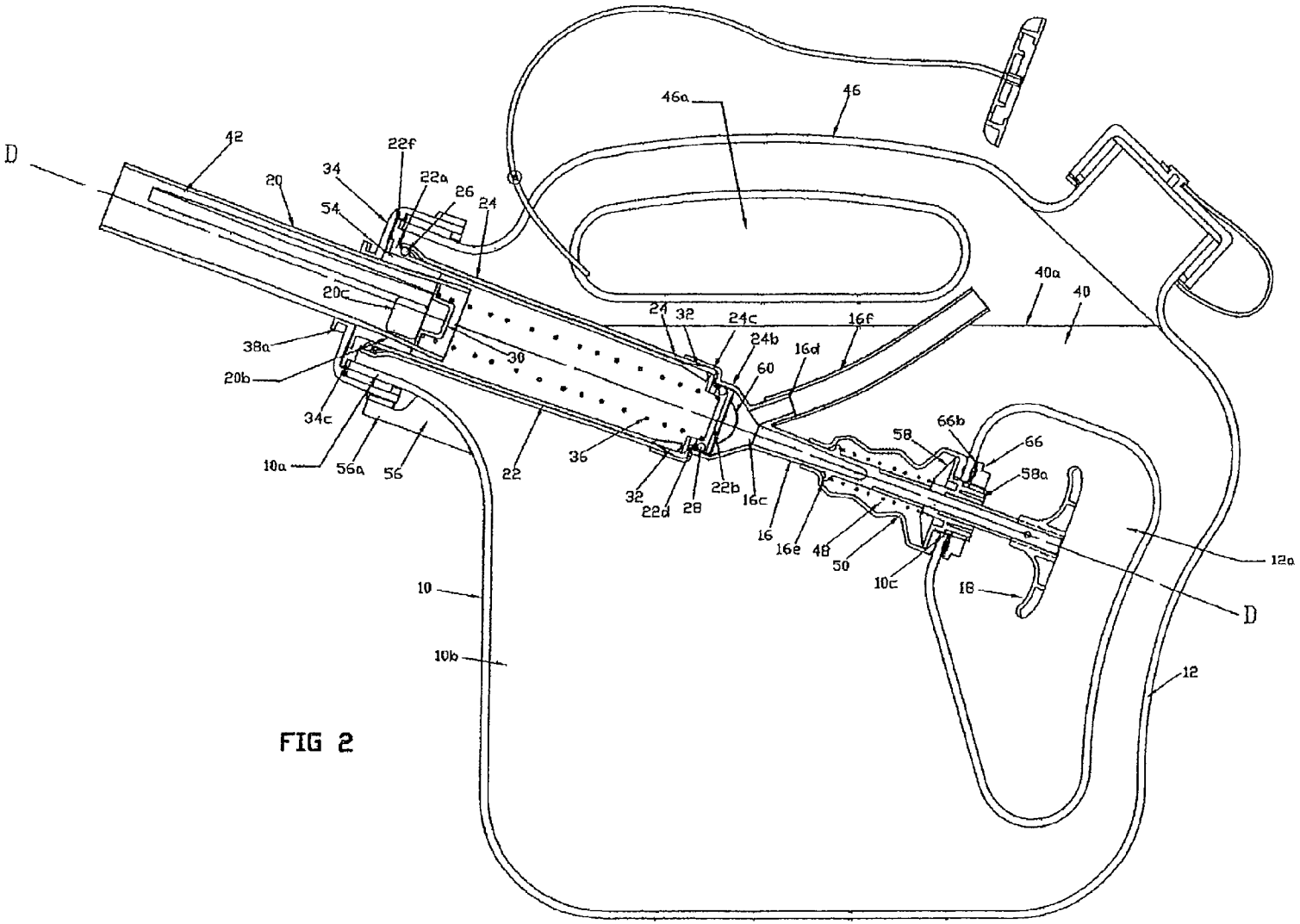
FIG. 2 illustrates the vessel of FIG. 1 with the spout released and extended out of the valve body, ready for dispensing fluid, showing, in section, the operator's grasping the pouring handle and trigger handle.
Figure 2A:
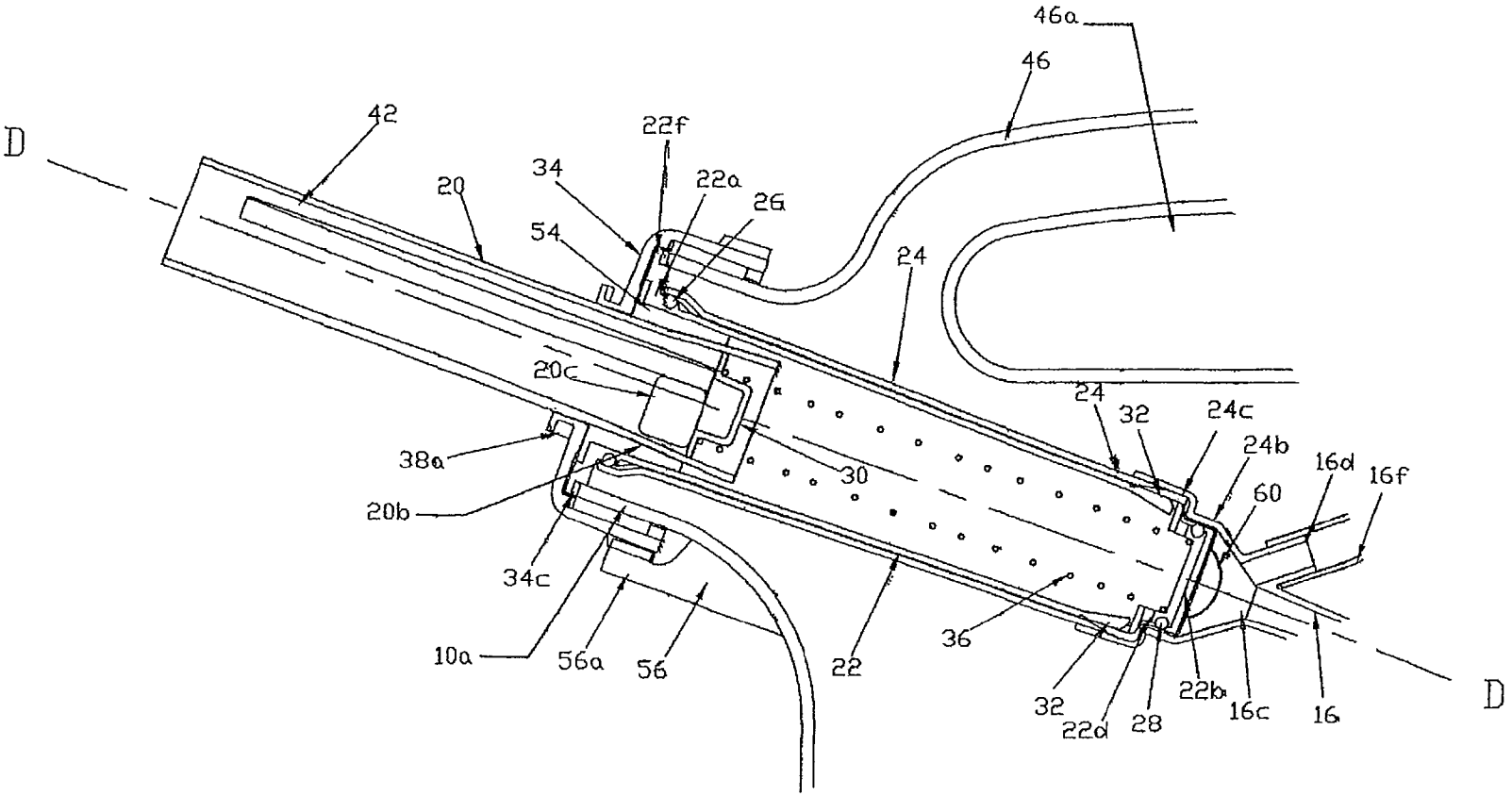
FIG. 2*a* is an enlarged view of a portion of FIG. 2 showing the valve seals.
Figure 2B:
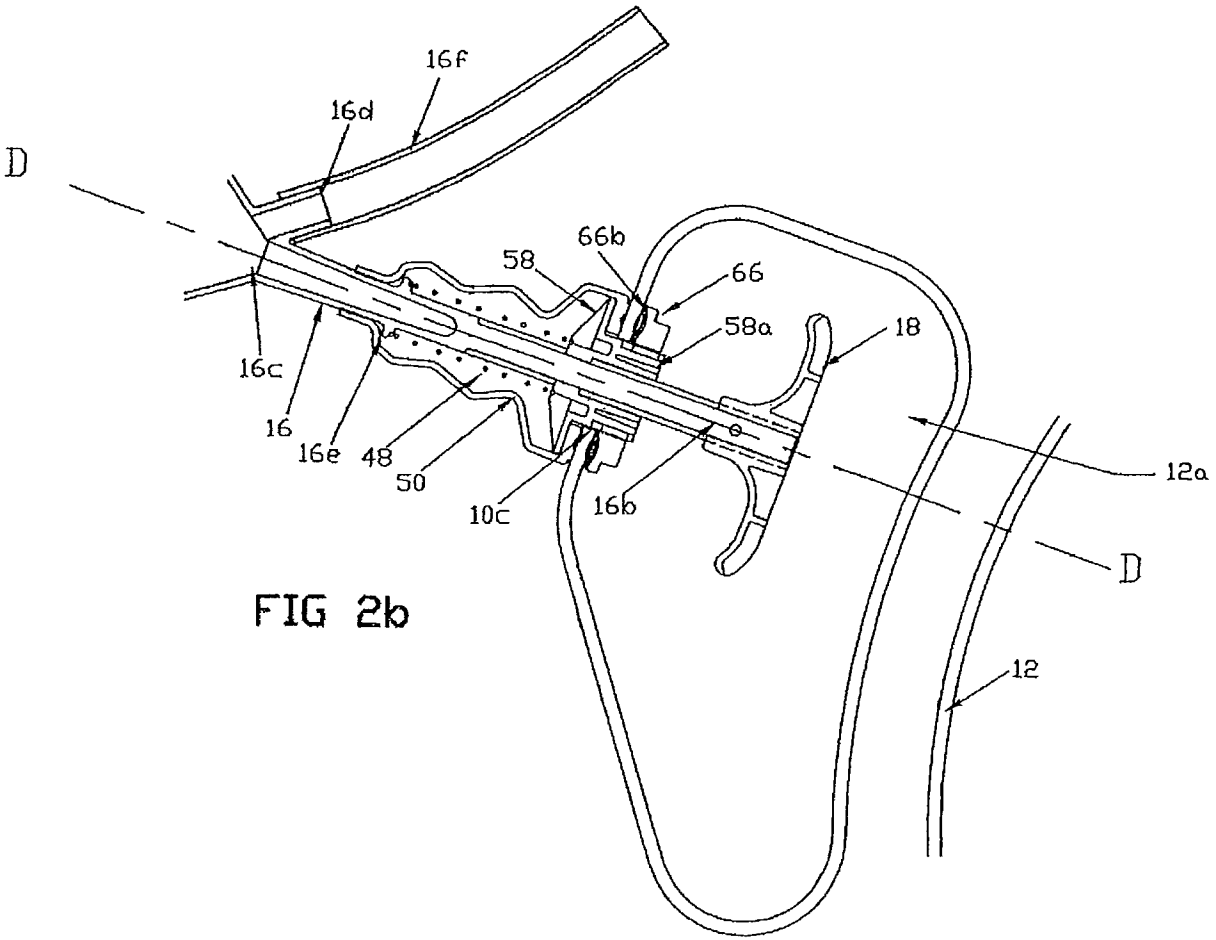
FIG. 2*b* is an enlarged view of a portion of FIG. 2 showing the trigger and valve shaft.

The hollow end 16*a* of valve shaft 16 is mounted to the upstream end 24*b* of valve outer sleeve 24 so that translation of valve shaft 16 in direction E, for example by the operator pulling trigger handle 18 away from handle side wall 10*b*, imparts a corresponding translation of valve outer sleeve 24 in direction C. Thus, valve outer sleeve 24 may be translated between its seal open position of FIG. 3 and its seal closed position of FIG. 2, wherein, respectively, primary and secondary seals 26, 28, shown as O-rings although this is not intended to be limiting as one skilled in the art would know that other forms of seals would also work, form fluid inhibiting seals between downstream ends 22*a* and 24*a* and between upstream ends 22*b* and 24*b*.

With valve outer sleeve 24 in its seal closed position, so that seals 26 and 28 are closed, fluid is inhibited from flowing from the interior 10*d* of vessel 10 through primary aperture 22*c* in valve main body 22 and corresponding aperture 20*c* in spout 20, and air is inhibited from flowing through secondary apertures 22*d* of valve main body 22.

Locking dogs 32 releasably lock valve outer sleeve 24 when in its seal closed position. Advantageously, locking dogs 32 are actuated so as to lock valve outer sleeve 24 in its seal closed position by the retraction of spout 20 into its storage position fully recessed within valve main body 22. In particular, resilient locking dogs 32 are engaged by upstream end 20*b* of spout 20 when spout 20 is seated within upstream end 22*b* of valve main body 22.

In one embodiment, when spout 20 is in its storage position such as seen in FIG. 1, the downstream end 20*a* is substantially flush with a valve retaining cap 34 mounted over spout aperture 10*a*. Seating of upstream end 20*b* of spout 20 so as to be nested and mated within upstream end 22*b* of valve main body 22, resiliently biases locking dogs 32 into correspondingly positioned notches or grooves 24*c* or other female depressions formed in the upstream end 24*b* of valve outer sleeve 24.

As spout 20 telescopically extends from valve main body 22, upstream end 20*b* releases from its biasing engagement against resilient locking dogs 32 thereby disengaging dogs from locking engagement in grooves 24*c*. Unlocked valve outer sleeve 24 may then be actuated by valve shaft 16 so as to translate valve outer sleeve 24 from its seal closed position into its seal open position.

In a preferred embodiment, which is not intended to be limiting, a spout ejection spring 36, which may as illustrated be a helical coil spring, is mounted in upstream end 22*b* of valve main body 22 so as to act upon spring plug 30 which may be inserted within the upstream end 20*b* of spout 20 thereby resiliently biasing spout 20 into its extended position extended from valve main body 22. Thus in order to engage locking dogs 32 so as to lock valve outer sleeve 24 into its seal closed position on valve main body 22, spout 20 is retracted into its storage position against the return biasing force of spout ejection spring 36. In order to store vessel 10 with spout 20 retracted and valve outer sleeve 24 thereby locked, a spout retainer is employed so as to releasably lock spout 20 in its stored position retracted within valve main body 22. In the illustrated embodiment, which is not intended to be limiting, the spout retainer is a spout retaining cap 38 which releasably mounts onto valve retaining cap 34 so as to cover the opening into downstream end 20*a* of spout 20.

Spring plug 30 may substantially close off the upstream 20*b* end of spout 20 fluid passage. This function assists in preventing the fluid 40 that is exiting from container 10 through apertures 22*c* and 20*c* and into the inner fluid cavity passage of the spout 20 from flowing over the dividing wall and into the separate air channel 42. Thus the exiting fluid may be directed toward the downstream end 20*a* of spout 20 without divergence. Further the spring plug provides a surface for the resilient spout spring 36 to act against in its function of ejection of the spout 20. The air channel 42 is continuous through and not blocked by the spring plug.

Figure 3:
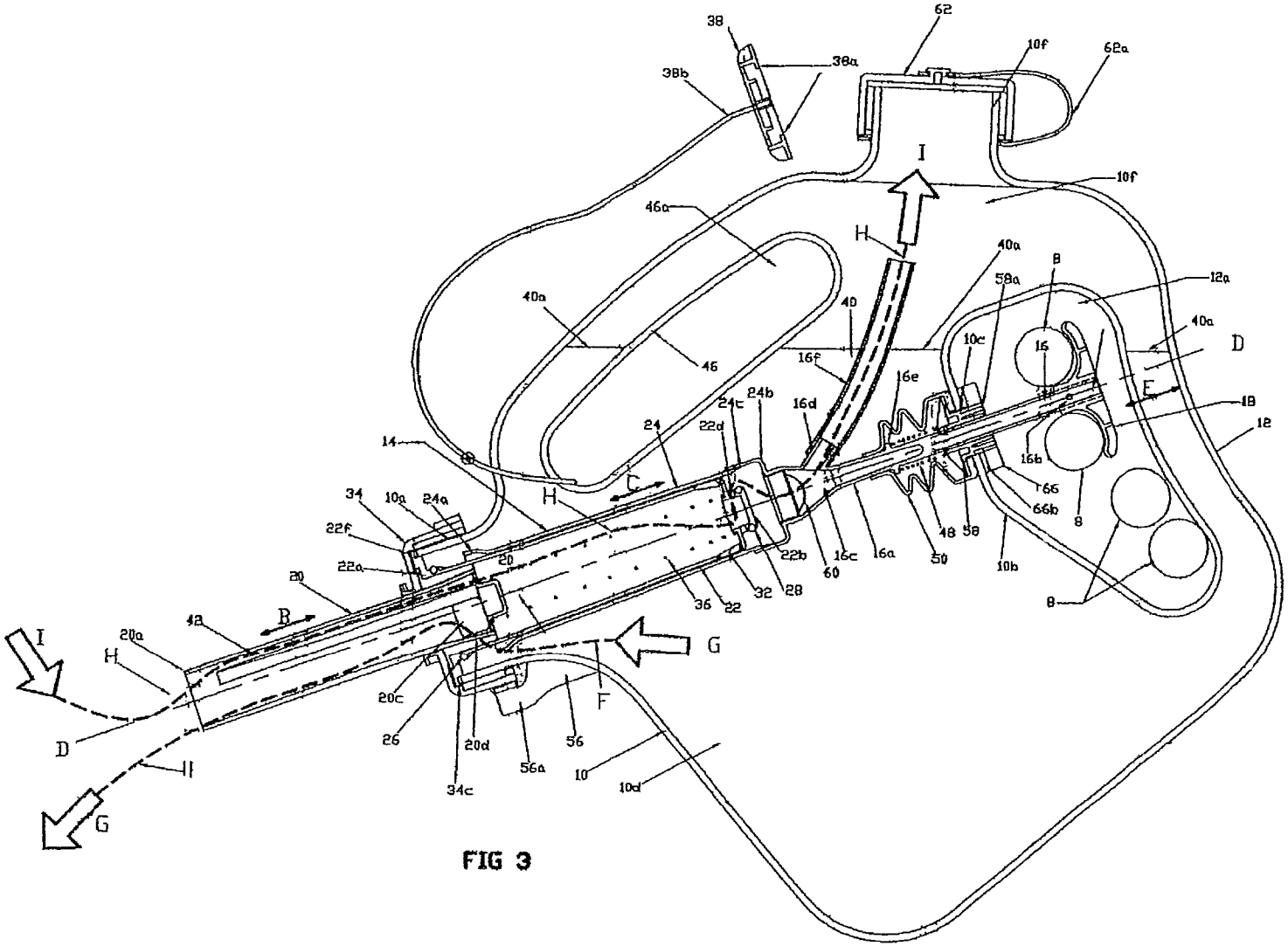
FIG. 3 illustrates the vessel of FIG. 2 with the vessel inclined at a typical pouring angle and the valve in the open position, and showing in dotted lines the path of the fluid flowing out of the vessel and the air flowing into the vessel.
Figure 4B:
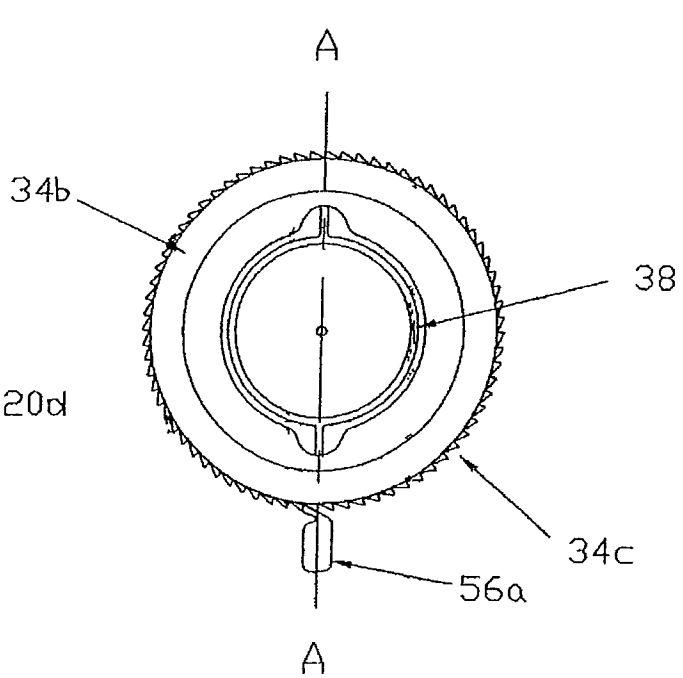
FIGS. 4*a* and 4*b* illustrate respectively two end views of the valve cap.
Figure 4A:
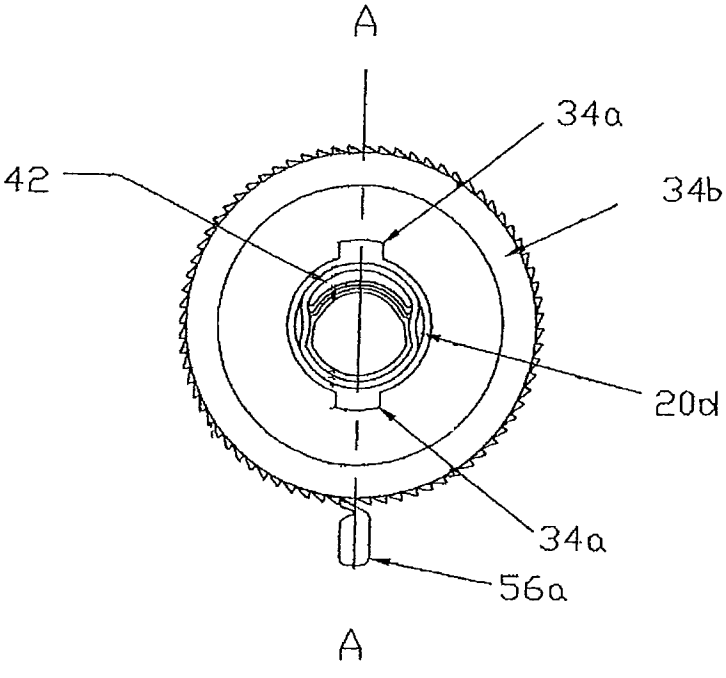
Figures 5A, 5B, 5C:
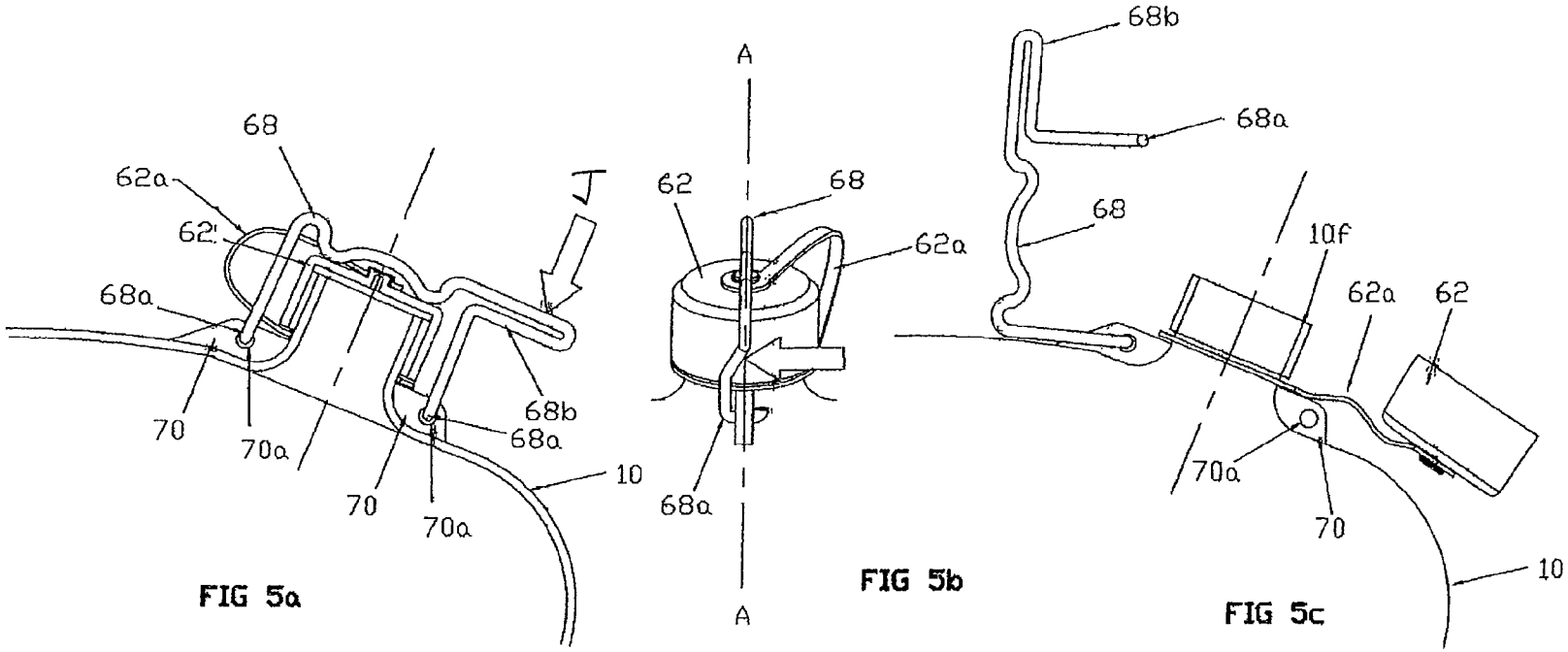
FIG. 5*a* illustrates in side sectional view the fill cap and safety spring lock for the cap on the top of the vessel.
FIG. 5*b* illustrates, in perspective view, the cap and safety lock of FIG. 5*a*.
FIG. 5*c* illustrates the cap and safety lock of FIG. 5*a*, with the cap and safety lock removed from the fill spout on top of the vessel.

As best seen in FIG. 3, when fluid 40 is stored within vessel 10 so that the fluid level 40*a* is above valve 14, and in particular above primary aperture 22*c* on valve main body 22 when vessel 10 is forwardly tilted into its pouring position with axis D downwardly forwardly inclined and when trigger handle 18 is retracted towards pouring handle 12 so that valve shaft 16 retracts valve outer sleeve 24 into its seal open position, fluid 40 flows through primary aperture 22*c* on valve main body 22 and through aperture 20*c* on spout 20, for example along the illustrated fluid path F in direction G so as to decant fluid 40 from spout 20.

An air channel 42 is preferably provided within spout 20, advantageously adjacent the upper side, and in the illustrated embodiment contained within spout 20, so as to allow the ingress of air, for example along airflow path H in direction I. Thus with axis D forwardly and downwardly inclined so as to pour fluid 40 from spout 20, the volume of fluid exiting vessel 10 may be replaced with a corresponding volume of air flowing through air channel 42 and thence upwardly along valve main body 22 so as to exit via secondary apertures 22*d* in valve main body 22 into hollow end 16*a* of valve shaft 16.

Air passage 16*c* extends along and within valve shaft 16 from hollow end 16*a* towards trigger handle end 16*b*. At least one port 16*d* is formed in valve shaft 16 in airflow communication with air passage 16*c* so that airflow along airflow path H may escape through port 16*d*, illustrated in FIG. 3. Port 16*d* may include an extension such as a flexible tube 16*f* to extend the air passage 16*c* upward towards and in some instances above the surface of the contained fluid 40 surface 40*a* in the passageway within vessel 10 formed between handle cavity 12*a* of pouring handle 12 and handle cavity 46*a* of carrying handle 46. Advantageously, port 16*d* is disposed upwardly.

In a preferred embodiment, a valve spring 48, which may, as illustrated be a helical coil spring, or other resilient biasing means, act on valve shaft 16 so as to resiliently bias valve outer sleeve 24 into its seal closed position. Thus an operator pulling on trigger handle 18 so as to retract handle 18 and valve shaft 16 towards pouring handle 12, retracts valve outer sleeve 24 into its seal open position against the resilient return biasing force of valve spring 48. Valve spring 48, the corresponding portion of valve spring 16, and shaft aperture 10*c*, may be sealed within a resilient sealing boot 50.

The location of the trigger handle provides significant safety, protection from damage if the vessel falls or is dropped, as the pouring handle will help protect the trigger handle from impact and possible damage.

Spout retainer cap 38 may be held in place on valve retaining cap 34 by two tabs 38*a* on the underside of spout retainer cap 38 that engage within sockets 34*a* on the valve retaining cap 34. Spring 36 acting on spout 20 holds the cap 38 in place, engaging tabs 38*a* within sockets 34*a*. Releasing retaining cap 38, by disengaging tabs 38*a* from sockets 34*a* allows spout 20 to freely extend from inside valve main body 22. Retaining cap 38 may be attached to vessel 10 via a tether 38*b*.

Spout ejection spring 36 acts, at least in part, against spring plug 30. Spout 20 is ejected by spring 36 until tapered upstream 20*d* end of spout 20 engages with a corresponding tapered surface within spout keeper bushing 54 stopping further extension of spout 20. A pair of opposed flat faces on spout 20 engage in and ride along a corresponding pair of longitudinally extending flat faces in the small bore of spout keeper bushing. Flat faces 20*d* on spout 20 extend along approximately % of the length of spout 20 from the downstream end 20*a* of spout 20. Thus when spout 20 is stopped by the tapered faces of spout keeper bushing 54 from further extension from valve main body 22 *a* short approximately ¼ of the length of spout 20 is retained within downstream end 22*b* of valve main body 22, at which point primary apertures 20*c* and 22*c* are aligned on spout 20 and valve main body 22 respectively communicating through substantially similarly placed apertures in spout keeper bushing 54. The flat faces of spout keeper bushing 54 which are slideably mated in grooves 20*d* prevent the rotation of the spout 20 relative to valve retaining cap 34. Thus air channel 42 is maintained in an orientation uppermost in spout 20.

The operator may either support vessel 10 by holding the carrying handle 46 or by holding the pouring handle 12 and, as necessary, also supporting the front of vessel 10 under front boss 56. The operator positions the downstream end 20*a* of the spout 20 in the location where fluid 40 is required before pulling of trigger handle 18.

Valve spring 48 may in one embodiment be mounted between collar 16*e* on shaft 16 and shaft support bushing 58. Trigger handle 18, when pulled, slides shaft 16 through the bore of support bushing 58. The bore of support bushing 58 may be keyed or otherwise formed to prevent the rotation of shaft 16.

Because it is likely that vessel 10 will distort due to heating and cooling, valve spring 48 is located and mounted such that, even when vessel 10 is distorted, such as when temperatures and vapours expand and contract within the vessel, valve spring 48 maintains a sufficient force upon shaft 16 and thus on valve outer sleeve 24 to maintain the primary and secondary seals 26, 28 closed.

In a preferred embodiment such as seen in FIG. 3, air flow along path H passes through a non-flammable screen such as flashback arrestor 60. Arrestor 60 may be included as a safety feature to assist in the prevention of ignition of fumes within vessel 10.

Port 16*d* in the shaft 16 is preferably disposed upwardly. The placement of port 16*d* at this greater distance from primary apertures 20*c*, 22*c* allows inflow of air behind the mass of out-flowing fluid 40, allowing air into the space behind the out-flowing fluid 40 which prevents formation of a vacuum within vessel 10. The use of air channel 42 as a separate air passage through spout 20 reduces the tendency for the incoming air to force its way back through the outward flow of fluid in spout 20 so as to cause gulping of air and thus interruption of a smooth flow of liquid out of the spout. The addition of an extension air tube 16*f* onto port 16*d* allows for an uninterrupted air passage to the back and uppermost portion of the vessel inner cavity 10*f*. This extension of the air passage H substantially eliminates the occurrence of fluid entering the air passage from the upstream end.

One end of sealing boot 50 is snugly mounted for a friction fit onto shaft 16, adjacent port 16*d* creating a vapour and fluid seal. Sealing boot 50 is sealed to the vessel sidewall 10*b* at bushing 58. The sealing boot 50 is clamped between bushing 58 and sidewall 10*b* by threaded post 58*a* journalled through shaft aperture 10*c*. Nut 66 threads onto the post 58*a* and clamps lock washer 66*b* against sidewall 10*b*. Aperture 10*c* and bushing 58 threaded post 58*a* are shaped to prevent rotation of post 58*a* in aperture 10*c*. For example, aperture 10*c* may be a D shaped hole.

Valve retaining cap 38 may include a lock to prevent accidental opening of the valve retaining cap. Valve securing boss 56, located on vessel 10 below threaded spout boss 10*a*, may include a protrusion or arm 56*a* which lies adjacent a sidewall 34*b* of valve retaining cap 34. Teeth 34*c* or other ratcheting means are mounted around sidewall 34*b*. Teeth 34*c* engage in a ratcheting cooperation with arm 56*a*. Thus teeth 34*c* lock against arm 56*a* to prevent the unthreading and unwinding of cap 38 from threaded spout boss 10*a*. Collar 22*f* is formed as an annular ring around downstream end 22*a* and is mounted onto the end of threaded spout boss 10*a* by cap 38 clamping collar 22*f* onto gasket 34*c*.

Filler cap 62 is mounted onto vessel 10 by threading cap 62 onto threaded filler boss 10*f* formed on the top of vessel 10. A securing strap 62*a* retains filler cap 62 on boss 10*f* when the cap is unthreaded and removed from the opening into boss 10*f*.

A securing spring clamp 68 may be provided to inhibit a child tampering with or opening filler cap 62. Spring clamp 68 straddles filler cap 62. The ends 68*a* of spring clamp 68 may be mounted by hooking ends 68*a* in apertures 70*a* in gussets 70 on either side of boss 10*f*. One end 68*a* may be unhooked from its corresponding aperture 70*a* by pushing down in direction J on a lever arm 68*b* formed so as to be cantilevered from the corresponding side of spring clamp 68. This releases the tension holding end 68*a* may be released from its aperture 70*a*.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A valved fluid transport container comprising a hollow vessel having a spout aperture and a first handle oppositely disposed on said vessel to said spout aperture, said first handle having a corresponding handle cavity, said handle cavity having a handle side wall common with said vessel, said handle side wall having a shaft aperture therein, nested first, second and third tubes mounted in said spout aperture, each of said first, second and third tubes having opposite downstream and upstream ends, said downstream and upstream ends having openings therein, wherein said first tube is telescopically nested for first telescopic motion relative to and within said second tube, and said third tube is telescopically mounted on, for second telescopic motion relative to said second tube, and wherein said second tube is rigidly mounted into said spout aperture, and wherein said first and second telescopic motions are along a common centroidal longitudinal axis of said tubes, and wherein said longitudinal axis intersects said first handle cavity, a valve shaft mounted along said longitudinal axis and journalled through said shaft aperture so as to dispose a handle end of said valve shaft in said first handle cavity of said first handle, an opposite hollow end of said valve shaft, opposite to said handle end, mounted to said third tube whereby translation of said valve shaft along said longitudinal axis translates said third tube between seal open and seal closed positions, and wherein, in said seal closed position, said third tube is in a lockable position when said first tube is in a corresponding storage position nested in said second tube, a selectively releasable lock mounted to, for selectively releasable locking cooperation between said second tube and said third tube when said third tube is in said lockable position, wherein when said lock is locked by said telescopic motion of said first tube into said storage position in said second tube so as to engage said lock and whereby said third tube is immobilized relative to said second tube, wherein a sidewall of said second tube has a fluid-flow aperture formed therein, and wherein said second tube has an airflow aperture formed therein, upstream of said fluid-flow aperture relative to a direction of fluid flow from said vessel and through said first and second tubes when decanting a fluid from said vessel, downstream and upstream seals on respectively said downstream and upstream ends of said second and third tubes, said seals sealing so as to prevent, when said third tube is in said seal closed position, said fluid flow through said fluid-flow aperture, and said airflow through said airflow aperture respectively, wherein as said first tube is telescopically extended from said second tube said downstream end of said first tube extends from said vessel and said upstream end of said first tube disengages so as to unlock said lock, whereafter translation of said valve shaft into said first handle cavity retracts said third tube from said seal closed position into said seal open position to thereby unseal said upstream and downstream seals so as to open a fluid path for said fluid flow, whereby said fluid in said vessel flows through said fluid-flow aperture and said extended first tube to exit from said first tube, and so as to open an airflow path for said airflow through said first and second tubes, through said airflow aperture, and into said vessel, and wherein said second and third tubes are permanently contained in, so as to be protected within said vessel, and wherein said first tube when in said storage position in said second tube is contained in so as to be protected within said vessel.

2. The container of claim 1 wherein said first tube includes an air channel to separate said air flow from said fluid flow and so as to define an airflow path which is separated from said fluid flow path in said first tube.

3. The container of claim 2 wherein said vessel has an upper end and an opposite lower end, and a front end and an opposite back end, and wherein said spout aperture is in said front end and said first handle is on said back end, and wherein said tubes have upper sides and opposite lower sides, and wherein said air channel is formed along said upper side of said first tube.

4. The container of claim 3 wherein said air channel is formed within said first tube.

5. The container of claim 1 wherein said lock includes at least one dog positioned in said second tube so as to be engaged by said first tube when in said storage position, and wherein said engagement of said first tube with said at least one dog biases an end of said at least one dog into locking engagement with said third tube, when in said seal closed position.

6. The container of claim 5 wherein said at least one dog includes at least one flexible member.

7. The container of claim 6 wherein said at least one dog includes at least one end of a spring.

8. The container of claim 1 wherein a first spring is mounted in said second tube so as to resiliently compress and expand between an upstream end wall of said upstream end of said second tube and said upstream end of said first tube to thereby resiliently bias said first tube to telescopically extend outwardly of said second tube from said storage position.

9. The container of claim 8 further comprising a second spring cooperating with said valve shaft to resiliently urge said third tube into said seal closed position.

10. The container of claim 9 wherein said second spring cooperates between said valve shaft and said handle side wall.

11. The container of claim 8 further comprising a retainer cap releasably mountable onto, so as to cover, said spout aperture when said first tube is in said storage position.

12. The container of claim 3 wherein said valve shaft has a hollow end opposite said handle end, said hollow end in airflow communication with said third tube, and wherein said airflow aperture is formed in said hollow end of said valve shaft so that said airflow path flows serially through said channel, said second tube, and said hollow end of said valve shaft.

13. The container of claim 12 wherein said airflow aperture is in a lower side of said hollow end.

14. The container of claim 13 wherein said tubes are substantially cylindrical and wherein said hollow end is substantially cylindrical.

15. The container of claim 12 wherein said fluid-flow aperture is formed in a lower side of said downstream end of said second tube and in a lower side of said upstream end of said first tube.

16. The container of claim 12 further comprising a flash-back screen mounted in said airflow path between said second tube and said airflow aperture.

17. The container of claim 1 wherein said tubes, said valve shaft, said spout aperture, said first handle and said first handle cavity all lie substantially in a common plane, said common plane substantially bisecting said vessel.

18. The container of claim 17 wherein said downstream end of said first tube is substantially flush with said spout aperture when in said storage position and wherein said handle end is substantially fully contained within said first handle cavity.

19. The container of claim 18 further comprising a second handle lying substantially in said common plane on said upper end of said vessel, said second handle for lifting and carrying said vessel.

20. The container of claim 19 further comprising a filling aperture on said upper end of said vessel, and wherein said second handle has a corresponding second handle cavity, and wherein said first handle cavity and said second handle cavity define a passageway therebetween within said vessel, and wherein said filling aperture is substantially aligned with said passageway so that said airflow escaping from said airflow aperture into said vessel rises through said passageway towards said filling aperture when said vessel is inclined forwardly to thereby tilt said longitudinal axis and said tubes for said decanting of said fluid flow, and further comprising a cap releasably mountable onto said filling aperture is releasably sealed by said cap.

21. The container of claim 12 wherein said airflow aperture is in an upper side of said hollow end.

22. The container of claim 21 further comprising a venting tube mounted to said airflow aperture so as to extend said venting tube upwardly within said vessel.

23. The container of claim 22 wherein said venting tube has an upper end, and wherein said venting tube is sufficiently long so as to position said upper end of said venting tube above the surface of the fluid contained in said vessel when said vessel is full of the fluid.

* * * * *